US006352134B1

(12) United States Patent
Wang

(10) Patent No.: US 6,352,134 B1
(45) Date of Patent: Mar. 5, 2002

(54) ACOUSTIC BOARD

(76) Inventor: Chao Hsiang Wang, P. O. Box 82-144, Taipei (TW)

( * ) Notice: Subject to any disclaimer, the term of this patent is extended or adjusted under 35 U.S.C. 154(b) by 0 days.

(21) Appl. No.: 09/618,478

(22) Filed: Jul. 18, 2000

(51) Int. Cl.[7] ..... E04B 1/92
(52) U.S. Cl. ..... 181/292; 181/293
(58) Field of Search ..... 181/292, 293, 181/284, 285, 286, 287, 288–295

(56) References Cited

U.S. PATENT DOCUMENTS 5,912,442 A * 6/1999 Nye et al. ..... 181/292
5,962,823 A * 10/1999 Asahara et al. ..... 181/286
6,125,965 A * 10/2000 Wang ..... 181/286
6,135,238 A * 10/2000 Arcas et al. ..... 181/292

* cited by examiner

*Primary Examiner*—Robert E. Nappi
*Assistant Examiner*—Kim Lockett
(74) *Attorney, Agent, or Firm*—A & J

(57) ABSTRACT

An acoustic board includes a rectangular frame, a rectangular panel formed with a plurality of conical holes and sized to engage with the rectangular frame, a plurality of large sound collecting members each having an open end and mounted on an inner bottom of the rectangular frame, and a plurality of small sound collecting members each having an open end and mounted on the inner bottom of the rectangular frame, whereby sound will be confined within the sound collecting members thereby largely decreasing noise in magnitude and therefore effectively isolating the noise from one side to another.

1 Claim, 12 Drawing Sheets

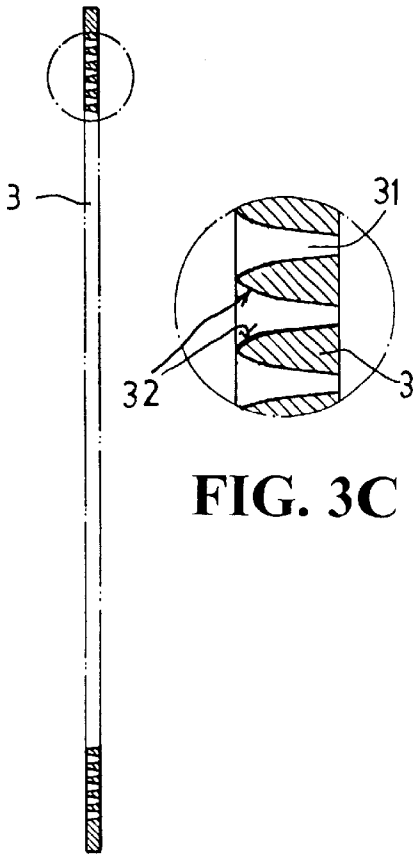
FIG. 3C
FIG. 3B
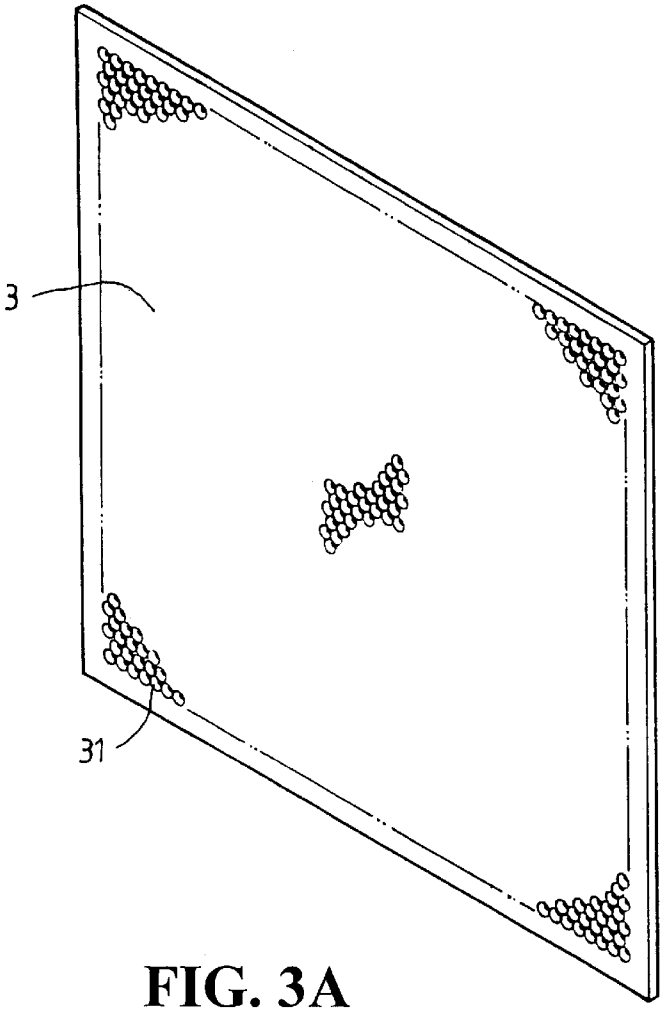
FIG. 3A

ACOUSTIC BOARD

BACKGROUND OF THE INVENTION

1. Field of the Invention

This invention is related to an improvement in the structure of an acoustic board and in particular to one which can effectively isolate the noise from one side to another.

2. Description of the Prior Art

It has been found that various conventional acoustic boards have been developed to meet the increasing need of isolating a noise from one side to the other. However, some are too bulky in volume and difficult to construct while others are too expensive for most people.

Therefore, it is an object of the present invention to provide an acoustic board which may obviate and mitigate the above-mentioned drawbacks.

SUMMARY OF THE INVENTION

This invention is related to an improvement in the structure of an acoustic board.

It is the primary object of the present invention to provide an improvement of an acoustic board which can effectively isolate the noise from one side to another.

It is another object of the present invention to provide an improvement of an acoustic board which is low in cost.

It is a further object of the present invention to provide an improvement of an acoustic board which is simple in construction.

According to a preferred embodiment of the present invention, an acoustic board includes a rectangular frame, a rectangular panel formed with a plurality of conical holes and sized to engage with the rectangular frame, a plurality of large sound collecting members each having an open end and mounted on an inner bottom of the rectangular frame, and a plurality of small sound collecting members each having an open end and mounted on the inner bottom of the rectangular frame, whereby sound will be confined within the sound collecting members thereby largely decreasing noise in magnitude and therefore effectively isolating the noise from one side to another.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 3A is a perspective view of the panel;

FIG. 3B is a sectional view of the panel;

FIG. 3C is an enlarged view of a portion of FIG. 3B;

DETAILED DESCRIPTION OF THE PREFERRED EMBODIMENT

Figure 1B:
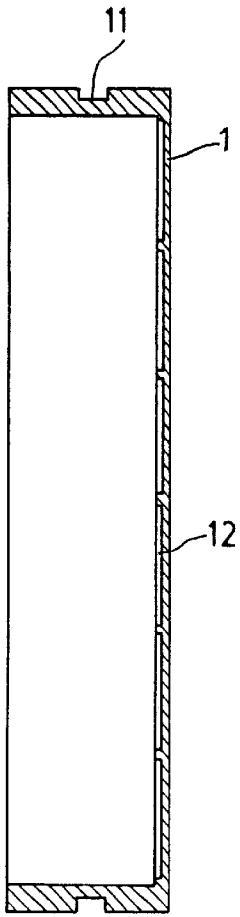
FIG. 1B is a sectional view taken along line B—B of FIG. 1.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
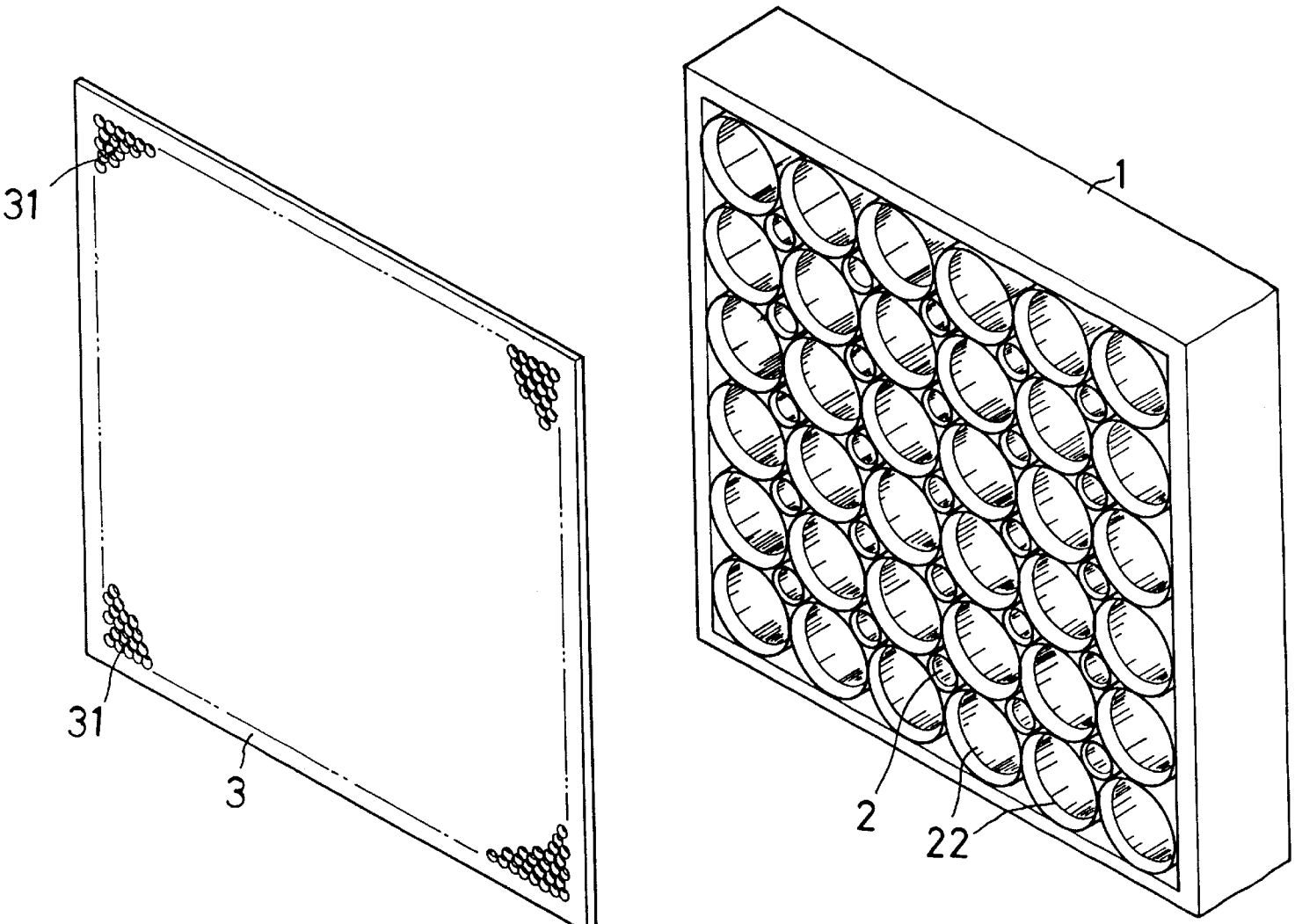
FIG. 4 is an exploded view of the present invention.
Figure 5:
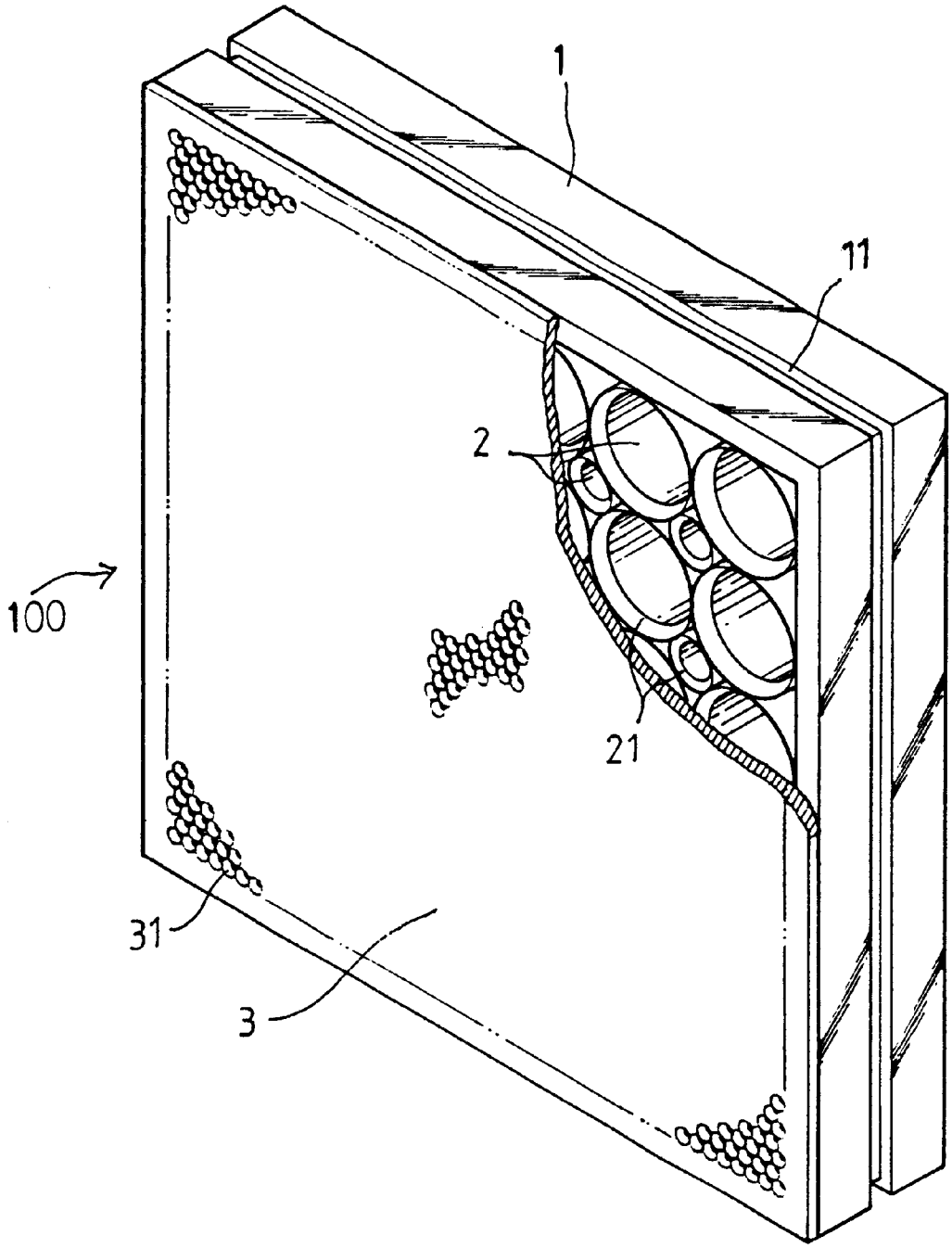
FIG. 5 is a cutaway view of the present invention.
Figure 6:
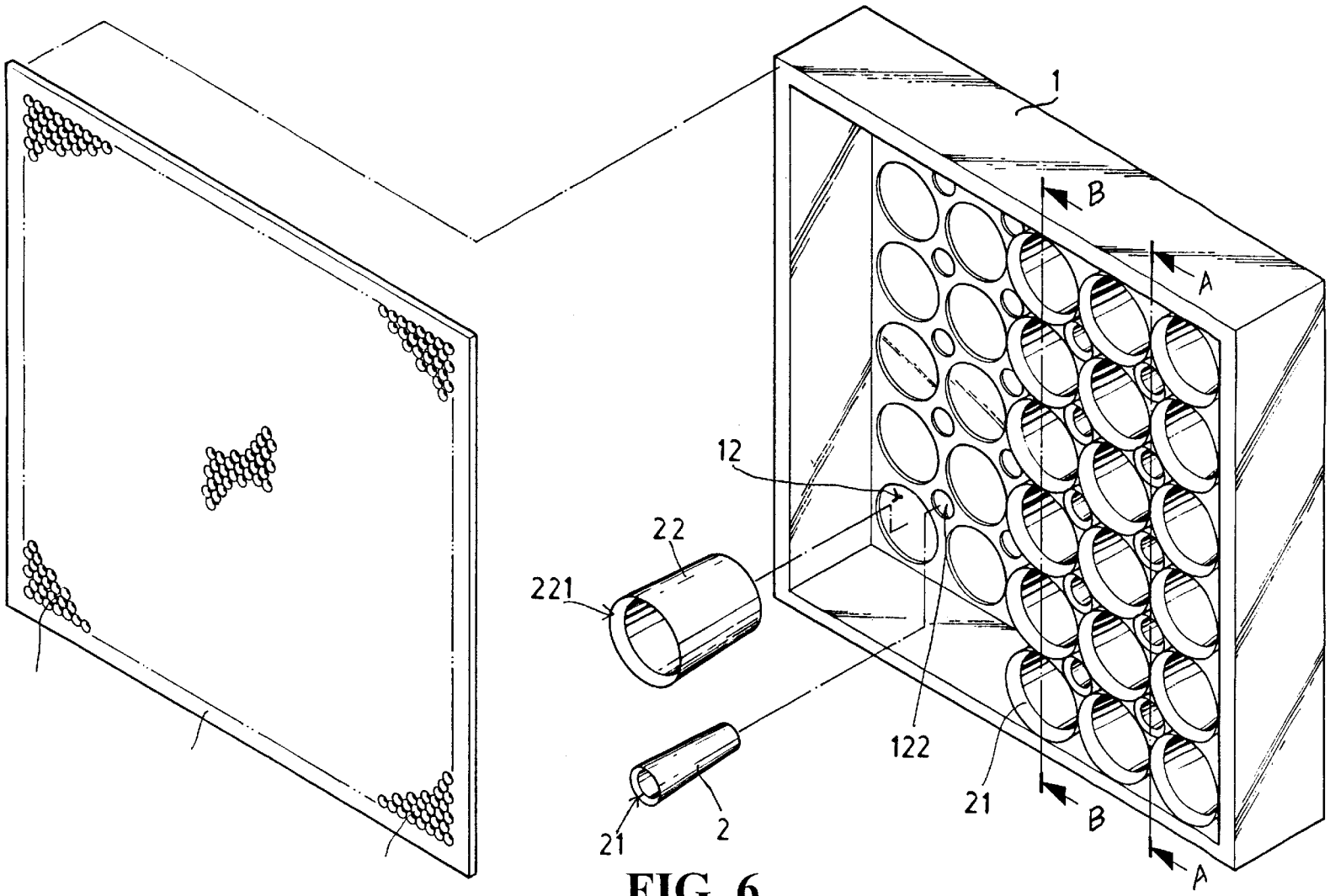
FIG. 6 is another exploded view of the present invention.

With reference to the drawings and in particular to FIGS. 4, 5 and 6 thereof, the acoustic board 100 according to the present invention generally comprises a frame 1, a panel 3 and a plurality of large and small sound collecting members 22 and 2.

Figure 1A:
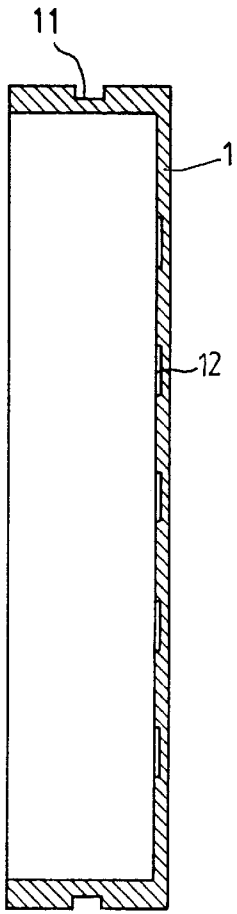
FIG. 1A is a sectional view taken along line A—A of FIG. 1.
Figure 1:
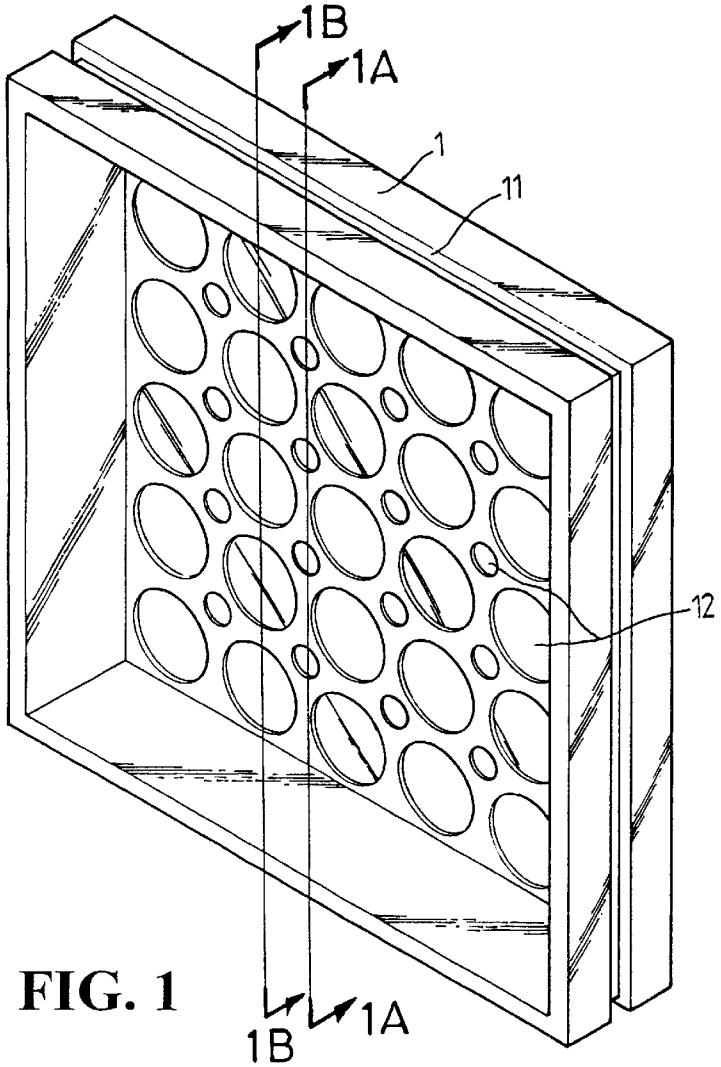
FIG. 1 is a perspective view of the present invention.

The frame 1 is a rectangular member formed with a plurality of large and small openings 12 and 122, and a groove 11 extending along the circumference thereof(see FIGS. 1, 1A and 1B). Further, the frame 1 has an inner bottom formed with a plurality of recesses 12 adapted to receive the sound collecting members 22 and 2.

The panel 3 (see FIGS. 3A, 3B and 3C) is a rectangular member formed with a plurality of conical openings 31 each having a chamfer 32 at its larger diameter.

Figure 2D:
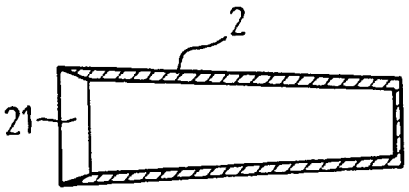
FIG. 2D is a perpective view of the small sound collecting member.
Figure 2C:
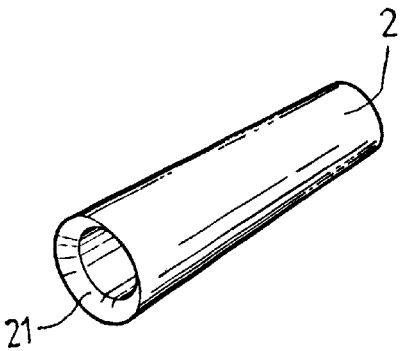
FIG. 2C is a sectional view of the small collecting member.
Figure 2A:
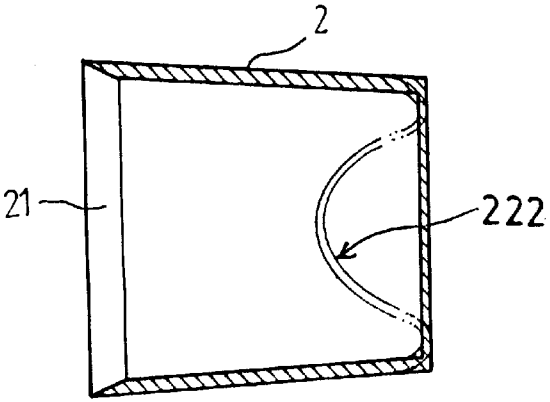
FIG. 2A is a sectional view of the large sound collecting member.
Figure 2B:
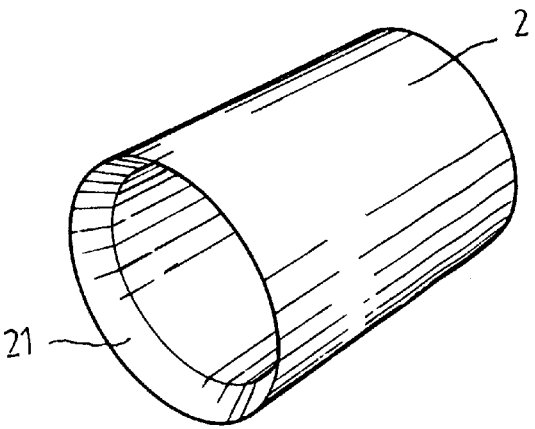
FIG. 2B is a perspective view of the large sound collecting member.

The large sound collecting member 22 is shown in FIGS. 2A and 2B. As shown, the large sound collecting member 22 is a conical member (or a cylinder) with an open top and a convex bottom 222 and sized to fit into a respective large opening 12. The open top of the large collecting member 22 is formed with a chamber 221. Referring to FIGS. 2D and 2E, the small sound collecting member 2 is also a conical member (or a cylinder) with an open top and a flat bottom and sized to fit into a respective small opening 122. The open top of the small collecting member 2 is also formed with a chamfer 21.

Figure 7C:
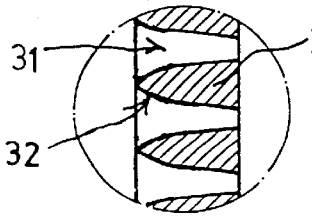
FIG. 7C is an enlarged view of a portion of FIG. 6.
Figure 7A:
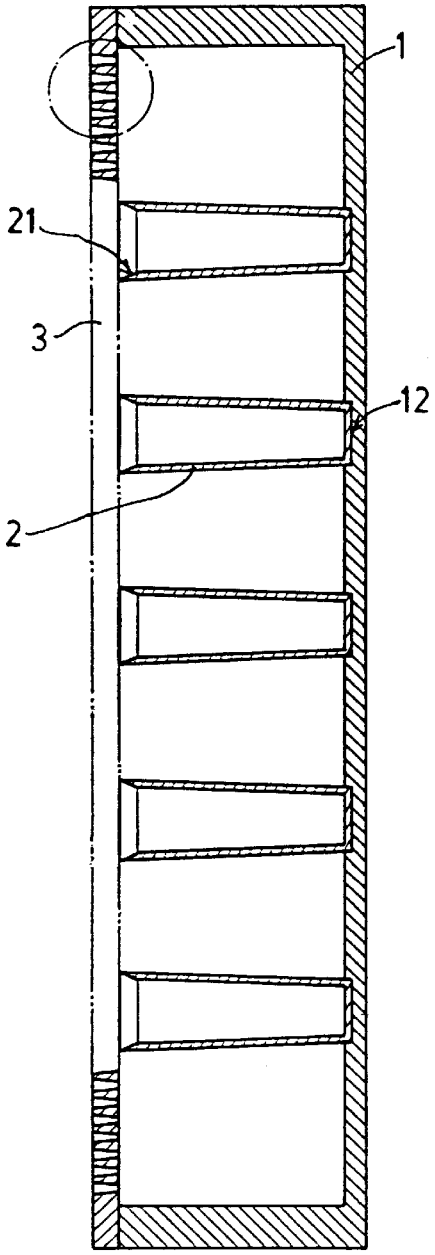
FIG. 7A is a sectional view taken along line A—A of FIG. 6.
Figure 7B:
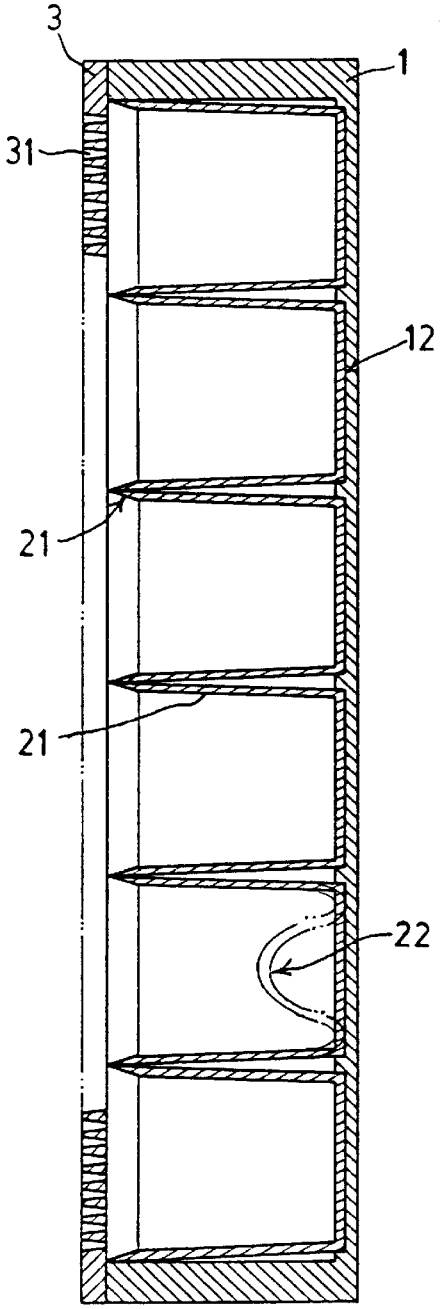
FIG. 7B is a sectional view taken along line B—B of FIG. 6.
Figure 8:
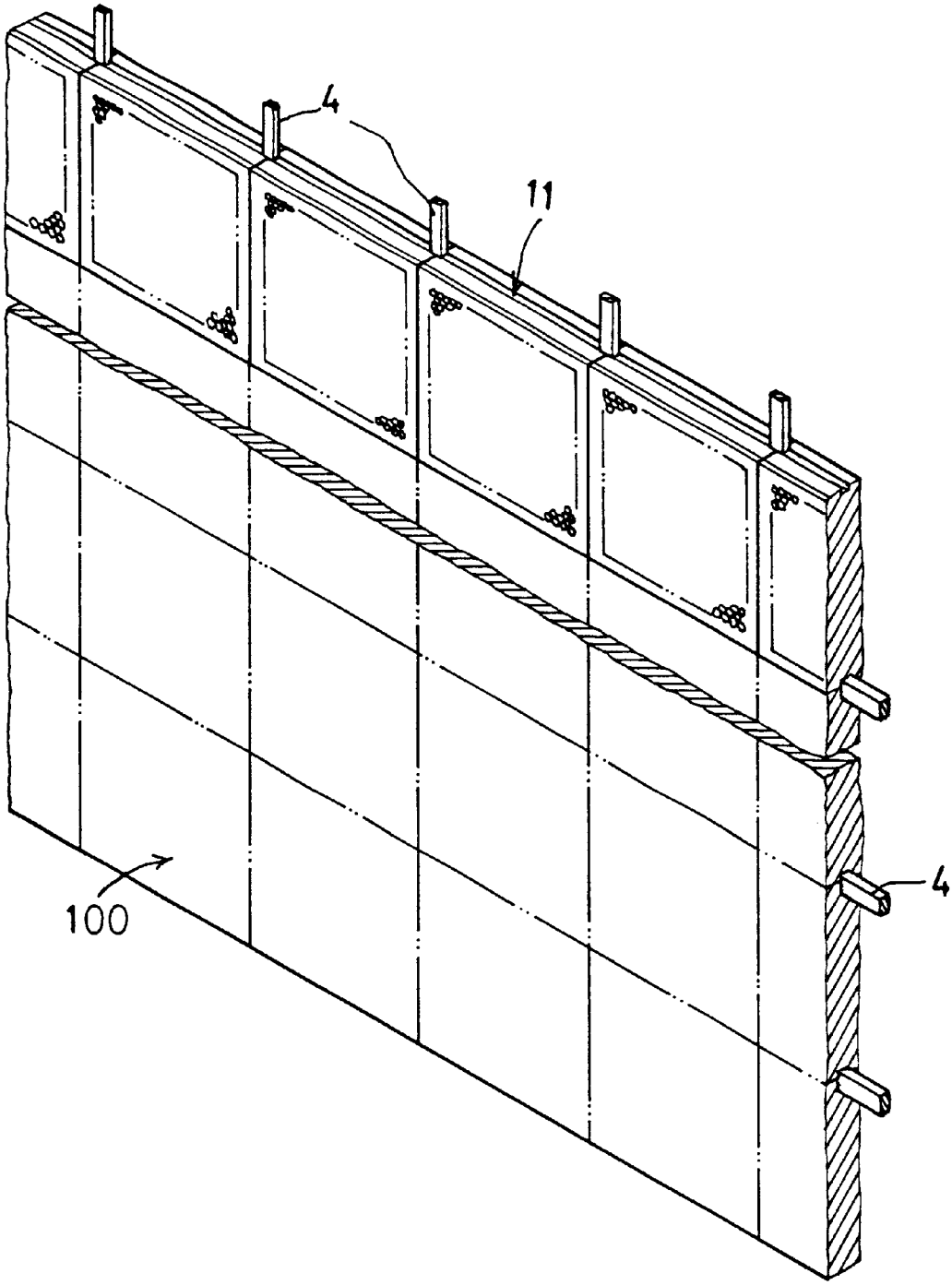
FIG. 8 illustrates an application of the present invention.

In assembly, the large and small sound collecting members 22 and 2 are fitted into respective large and small openings 12 and 122 of the frame 1 and the panel 3 is mounted on the front side of the frame 1 (see FIGS. 7A, 7B and 7C) so that the sound will be confined within the sound collecting members 2 and 22 thereby largely decreasing the noise in magnitude and therefore effectively isolating the noise from one side to another.

As shown in FIGS. 1, 1A, 1B and 8, a plurality of the acoustic boards 100 may be assembled together to form a large acoustic board by engaging the grooves 11 of the acoustic boards 100 with a frame 4.

Furthermore, a large acoustic board can be easily formed by joining a plurality of frames 1 by high frequency welding and then affixing a plurality of panels 3 to the frames 1 by high frequency welding thereby making it unnecessary to prepare large molds for manufacturing large acoustic boards and therefore lowering the cost of manufacturing large acoustic boards.

Figures 9, 9A:
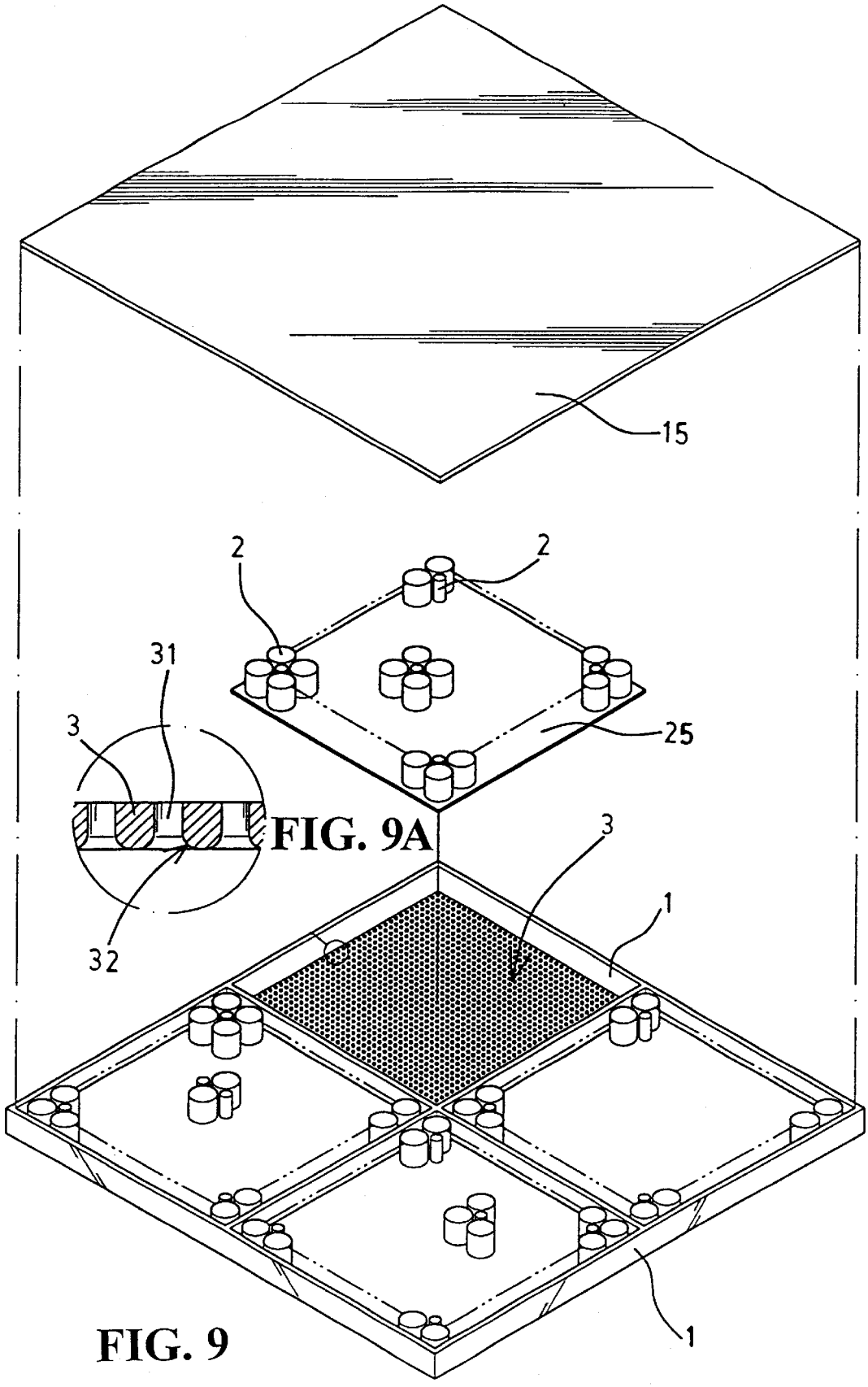
FIG. 9 is an exploded view of a second preferred embodiment of the present invention.
FIG. 9A is an enlarged view of a portion of FIG. 9.
Figure 11:
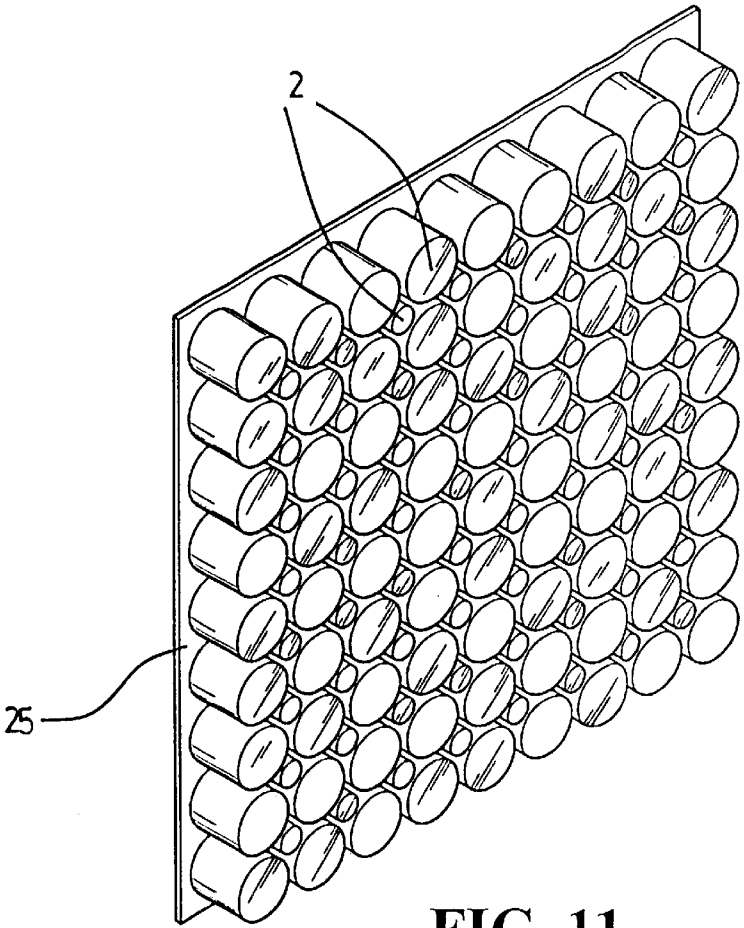
FIG. 11 is another perspective view of the sound collecting board.
Figure 10:
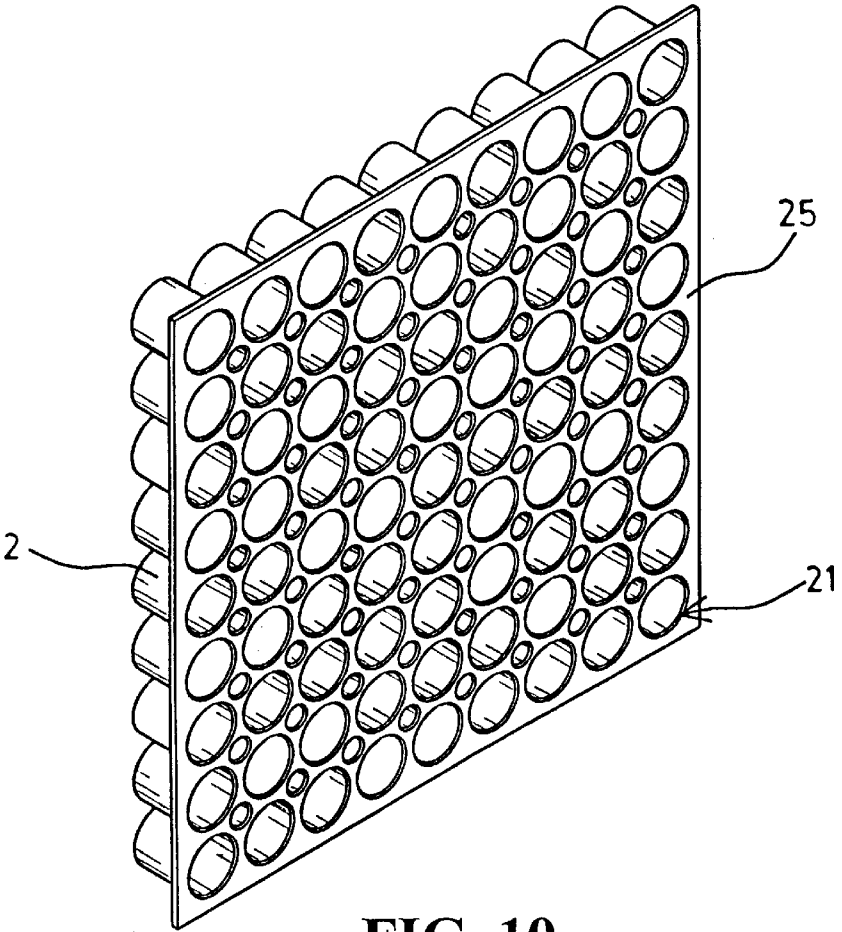
FIG. 10 is a perspective view of the sound collecting board.

FIGS. 9 and 9A illustrate another preferred embodiment of the present invention. As shown, a plurality of large and small sound collecting members 2 are integrally formed with a sound collecting board 25 (see also FIGS. 10 and 11) which is sized to fit into the frame 1, so that when in assembly, the sound collecting board 25 is arranged inside the frame 1 and then a cover 15 is engaged with the bottom of the frame 1 to form an acoustic board. The cover 15 may be formed integrally with the frame 1.

Figure 12:
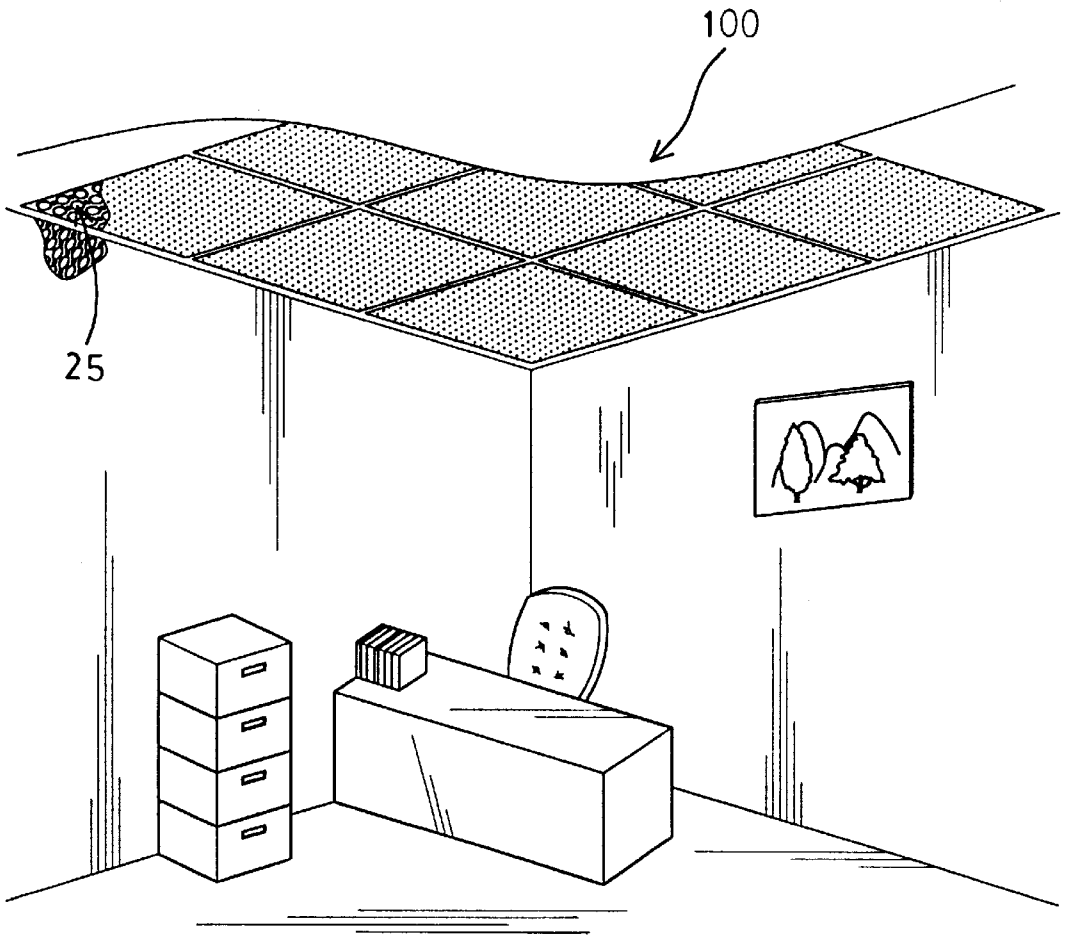
FIG. 12 illustrates a first working view of the present invention.
Figure 13:
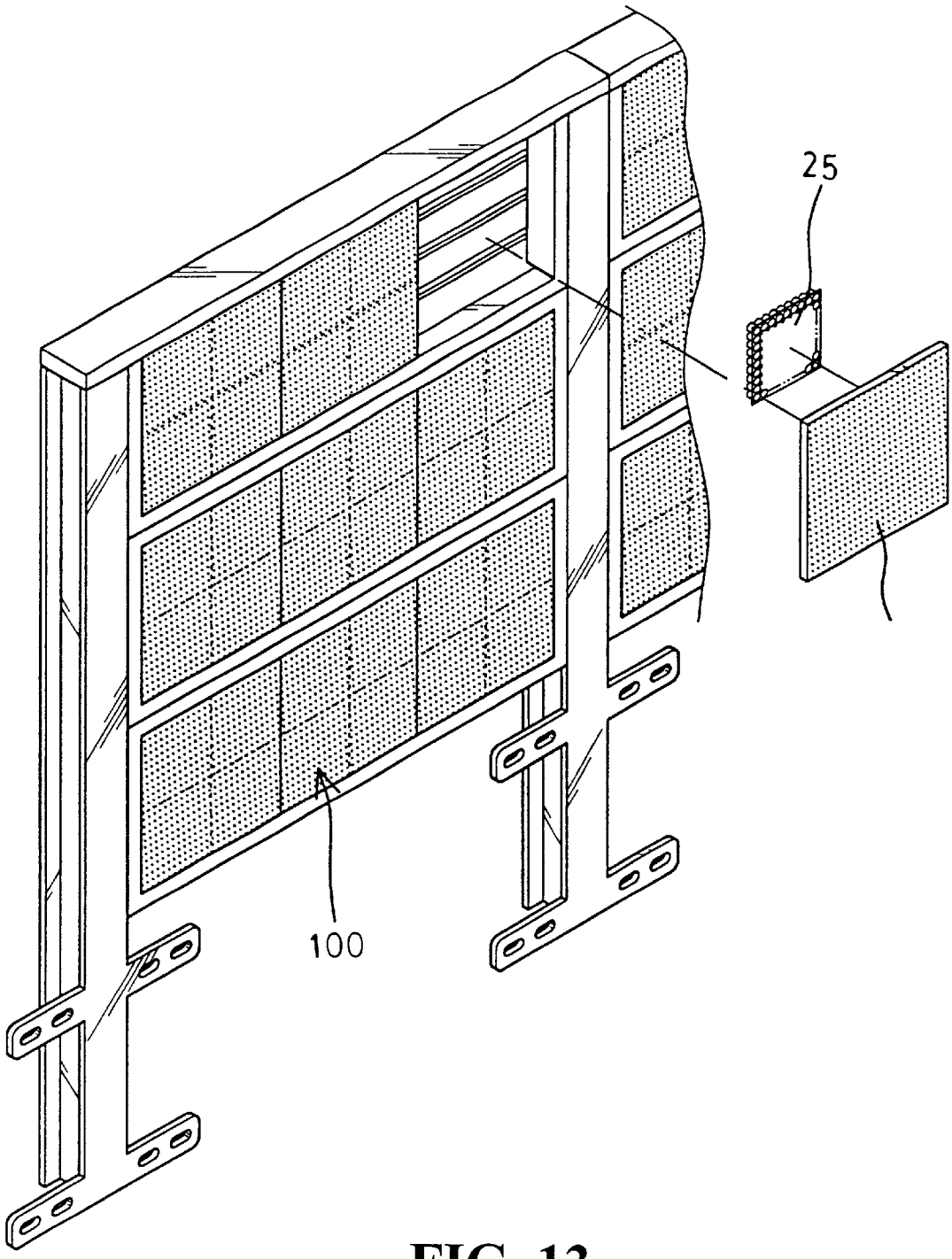
FIG. 13 illustrates a second working view of the present invention.

Referring to FIG. 12, the acoustic boards according to the present invention can be easily mounted on the ceiling as a ceiling board. In addition, the acoustic boards according to the present invention can be mounted on two sides of a free way and used as a noise barrier (see FIG. 13).

However, it should be noted that the sound collecting members 2 and 22 are not limited to cylindrical in shape and may be of any other shapes without sharp edges.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An acoustic board comprising:

rectangular frame having a groove extending along a circumference thereof, said frame having a bottom integrally formed thereof;

a rectangular panel formed with a plurality of conical holes and sized to engage with said rectangular frame, said conical holes of said panel being chamfered at large diameter thereof;

a plurality of large sound collecting members each having an open end and mounted on an inner bottom of said rectangular frame; and a plurality of small sound collecting members each having an open end and mounted on said inner bottom of said rectangular frame, said sound collecting members being integrally formed with a sound collecting board;

whereby sound will be confined within said sound collecting members thereby largely decreasing noise in magnitude and therefore effectively isolating the noise from one side to another.

* * * * *